United States Patent [19]

McLean

[11] Patent Number: 4,871,047

[45] Date of Patent: Oct. 3, 1989

[54] ADJUSTABLE GRAB IRON

[75] Inventor: Leonard A. McLean, Jacksonville, Fla.

[73] Assignee: CSX Transportation, Incorporated, Baltimore, Md.

[21] Appl. No.: 239,363

[22] Filed: Sep. 1, 1988

[51] Int. Cl.[4] ..... E06C 9/04

[52] U.S. Cl. ..... 182/90; 182/228; 105/461

[58] Field of Search ..... 105/354, 461; 182/90, 182/228, 99

[56] References Cited

U.S. PATENT DOCUMENTS 3,468,093 9/1969 Fuss et al. ..... 182/228 X
4,463,827 8/1984 Sittner ..... 182/90 X

FOREIGN PATENT DOCUMENTS 1006702 10/1965 United Kingdom ..... 182/228

*Primary Examiner*—Johnny D. Cherry
*Assistant Examiner*—Gary C. Hoge
*Attorney, Agent, or Firm*—Sughrue, Mion, Zinn, Macpeak, and Seas

[57] ABSTRACT

This invention relates to grab irons and more particularly to two-piece, adjustable grab irons. The grab iron consists of a handhold-shape containing a mounting flange portion and a rod member as well as a grabfoot-shape containing a mounting flange portion and a base portion having a ring with a hole sized to receive the rod member of the handhold-shape. The rod member possesses a series of holes that are spaced along at least a portion of the rod member, and are formed at the same angle as measured from a horizontal vector. The base portion has a single pin hole having a size and angle that permits alignment with any of the pin holes in the rod member. The two pieces are secured together by the use of a metal fastener such as a steel expansion pin or a screw that is placed through both the pin hole in the base member and the appropriate hole in the rod member. The excess portion of the rod member extending past the grabfoot-shape is cut off. Furthermore, the base ring hole is formed by drilling or casting the grabfoot-shape, producing a torus shaped base portion, and resulting in a secure fit between the rod member and the base portion ring.

12 Claims, 3 Drawing Sheets

ADJUSTABLE GRAB IRON

FIELD OF THE INVENTION

The present invention concerns handholds and footholds for vertical structures and, in particular, is directed to grab irons that are used on vehicles such as railroad cars and the like.

BACKGROUND OF THE INVENTION

Grab irons are used on transportation vehicles such as railroad cars to provide a support device for easy mounting and dismounting of the vehicle. Persons may hold onto the grab iron to safely enter or exit the vehicle. The grab iron may also be used in forming a step to climb onto the vehicle. In addition, a series of grab irons may be placed on a structure such as a railcar, water tower, or oil tank, forming a ladder.

In the railway industry, applicable regulations require rolling stock to have in place a full complement of undamaged grab irons for the safety of railroad personnel. Fines may be imposed by inspectors if damaged or missing grab irons are not replaced promptly. This requires the stocking of many sizes of grab irons with varying configurations. If the replacement grab iron configuration required for a particular car is not available, the freight being transported may be subject to delays in delivery while the required grab iron is ordered.

Two-piece, adjustable grab irons reduce the great deal of space and expense required to store the many one piece configurations of grab irons in case of replacement or repair, as discussed in U.S. Pat. No. 4,463,827 to Sittner. In addition, they avoid delays in ordering the desired grab iron configuration. By combining a handhold-shape, comprising a mounting flange portion and a rod member, as well as a grabfoot-shape, comprising a mounting flange portion and a base portion having a ring to receive the rod member, the grab iron is capable of meeting most if not all longitudinal distances between fastening points on railway cars. In addition, the flange portions of both pieces may have a variety of straight and offset configurations, and yet be combinable, thereby increasing the number of possible configurations.

However, the prior art embodied in the Sittner patent teaches that in order to secure the two pieces together, once they have been spaced a desired distance apart and mounted, with the rod member inserted through the ring, the rod member must be cut to an appropriate length, leaving an excess portion extending through the ring on the base, and then mechanically deformed to prevent the exit of the rod member from the ring. This structure creates several problems. First, the excess length must be properly judged in order to have sufficient material to create a sufficient bend for securing the grabfoot-shape. If the length is too short, a proper bend may not be possible. This results in an ineffective and hazardous joint or requires a new piece to be tried again. Second, even when properly made, the bend creates protrusions that can cut a worker or catch a glove, shoe or cuff when the worker is mounting or dismounting a railcar.

In addition, the prior art teaches that the base portion is formed by bending metal in a circular fashion, resulting in a ring having a center hole to receive the rod member. The ring has an incomplete torus shape. However, when the rod member is bent to secure the grabfoot-shape, the pressure exerted on the base portion has a tendency to increase the opening in the torus shape, which results in an insecure fit between the rod member and the base portion.

Accordingly, one object of the invention is to provide a two-piece, adjustable grab iron whose members are secured by the use of a metal fastener.

Another object of the invention is to provide a safe, easy, and efficient method of securing a two-piece, adjustable grab iron together.

A further object of the invention is to provide an improved base portion design where the base portion comprises a metal ring that completely surrounds the rod member, the hole in the center of the ring being formed by drilling or casting the base portion.

SUMMARY OF THE INVENTION

In accordance with the present invention, a grab iron comprises a handhold-shape containing a mounting flange portion and a rod member as well as a grabfoot-shape containing a mounting flange portion and a base portion having a ring with a hole sized to receive the rod member of the handhold-shape. The ring is formed by drilling or casting the base portion. The rod member contains a series of pin holes that are spaced along at least a portion of the rod member. Each of the holes is formed at the same angle in a common plane passing through the rod, and may extend from the front top surface of the rod to the rear bottom surface. The base portion ring also has a pin hole, having a size and angle that permits alignment with any of the holes along the length of the rod member. The handhold-shape and grabfootshape are fastened together by the use of a steel expansion pin or similar fastening means placed through both the pin hole in the base portion ring of the grabfoot-shape and through one of the pin holes in the rod member that has been aligned with the pin hole in the base.

The invention improves the prior art by eliminating the potentially hazardous and inefficient step of bending the rod portion of the handhold-shape to secure the grabfoot-shape. The invention eliminates the risk of a worker being injured by the metal bent to secure the grabfoot-shape. In addition, the invention eliminates the wasting of handhold-shapes caused by cutting off too much of the rod member, resulting in a new handhold-shape to be tried again. Finally, the invention provides a more secure fitting between the rod member and the base portion ring due to the fact that the base portion ring is a complete torus shape.

BRIEF DESCRIPTION OF THE DRAWINGS

In the detailed description of the preferred embodiments below, reference is made to the accompanying drawings, in which.

DESCRIPTION OF THE PREFERRED EMBODIMENTS

Figure 1:
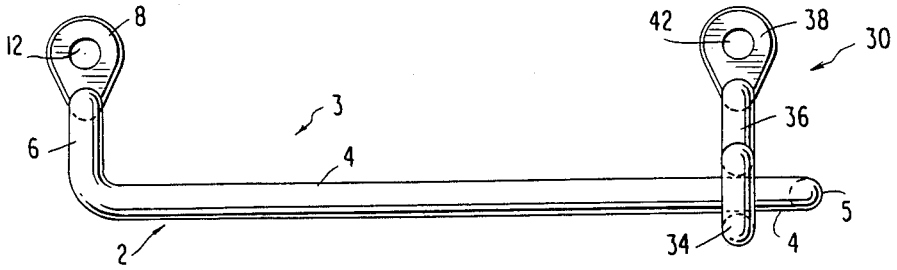
FIG. 1 PRIOR ART
FIG. 1 is a front elevation view of the prior art.
Figure 2:
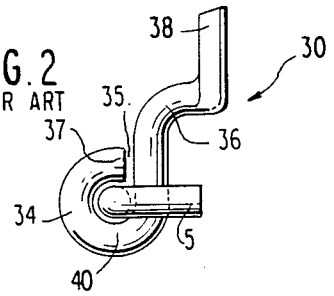
FIG. 2 PRIOR ART
FIG. 2 is a side elevation view of FIG. 1.
Figure 3:
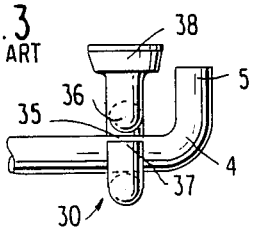
FIG. 3 PRIOR ART
FIG. 3 is a plan view of a portion of FIG. 1.

Referring now to the accompanying drawings, the two-piece, adjustable grab iron configuration of the prior art is designated generally by the numeral 3, illustrated in FIGS. 1, 2 and 3. The assembly of the prior art comprises a first member 2, called a handhold-shape, which includes a rod member 4, a flange portion 6, and a mounting portion 8. The mounting portion 8 includes an opening 12 capable of receiving a fastener to secure the handhold-shape 2 to the railway car. The length of the rod member 4 is sufficient to accommodate most, if not all, of the sizes encountered on railway cars and other transportation vehicles.

The second member 30, called a grabfoot-shape, comprises a base portion 34 containing a ring 40 which has a center hole that is sized to receive the rod member 4 of the handhold-shape 2. The grabfoot-shape 30 also includes a flange portion 36 and a mounting portion 38 which has an opening 42 capable of receiving a fastener to attach the grabfoot-shape to the railroad car. In order to secure the grabfoot-shape 30 in place, the end 5 of the rod member is cut to the appropriate length and mechanically deformed, as is best illustrated by FIG. 2.

The prior art teaches that the base portion 34 is formed by bending metal to form the ring 40 and not by drilling a hole in a metal blank or by casting. Such a bending leaves an opening 35. That opening may be increased from pressure exerted when the rod member is bent to secure the grabfoot-shape, weakening the fastening between the handhold-shape and grabfoot-shape. The opening also may be increased as pressure is applied to the grab iron during use as a handhold or foothold. As a result, the edge 37 of the opening 35 may injure a railway worker if the base portion is improperly formed or if the opening is increased when the rod member is bent to secure the grabfoot-shape.

The prior art 3 further teaches that the flange portions 6 and 36 may be varied, increasing the number of allowable configurations. Straight, straight-offset, single-offset, and double-offset handhold-shapes may be combined with straight-offset, single-offset, and double-offset grabfoot-shapes.

Because the end 5 of the rod member 4 must be cut to the appropriate length and bent to secure the grabfoot-shape 30, several problems arise. If the length of the rod member 4 is cut too short, a proper bend may not be possible. This results in an ineffective and hazardous joint or requires a new piece to be tried again. In addition, even when properly made, the bend creates protrusions, best illustrated in FIG. 3, that can cut a worker or catch a glove or clothing when the worker is mounting or dismounting the railcar. This is particularly dangerous when a worker is mounting or dismounting while a car is moving or, even if stationary, when the grab iron is wet or covered with snow and ice.

Figure 8:
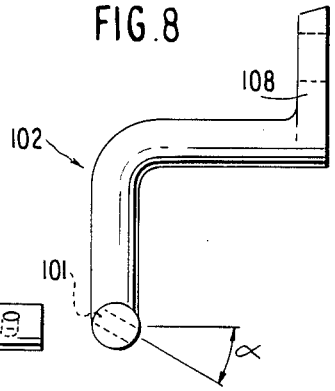
FIG. 8 is a side elevation view of FIG. 7.
Figure 9:
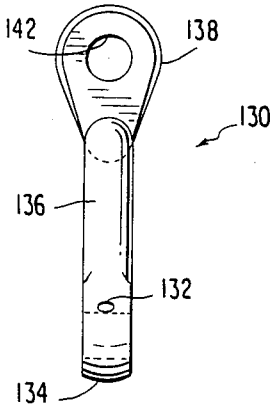
FIG. 9 is a front elevation view of the double-offset grabfoot-shape of the present invention, employed in FIG. 4.
Figure 10:
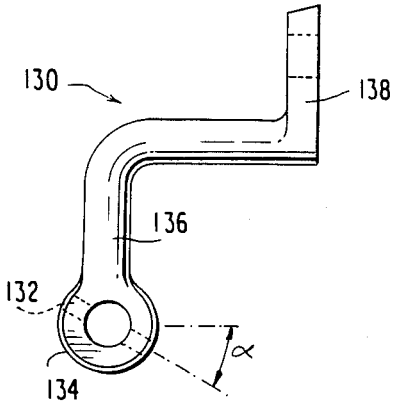
FIG. 10 is a side elevation view of FIG. 9.

A grab iron assembly of the present invention is illustrated in FIGS. 4 through 11 of the drawings and is referenced generally at 110. This assembly comprises a first handhold-shape member 102, which includes a rod member 104, a flange portion 106, and a mounting portion 108. The mounting portion 108 includes an opening 112 capable of receiving a fastener to secure the handhold-shape 102 to the railway car. The rod member 104 possesses a series of pin holes 101 that are spaced along at least a portion of the rod member 104. The length of the rod member 104 is sufficient to accommodate most, if not all, of the sizes used on railway cars. Each of the holes 101 is formed at the same angle $\alpha$, measured from a horizontal vector, as is best illustrated by FIG. 8, and lies in a common plane. The holes 101 may extend from the top surface to the rear bottom surface of the rod member 104. In addition, holes 101 may be regularly spaced along rod member 104.

The assembly comprises a second grabfoot-shape member 130, which includes a mounting portion 138, a flange portion 136, and a base portion 134 having an integral ring 140 that includes a center hole which is sized to receive the rod member 104 of the handhold-shape 102. The ring 140 is formed during manufacture of the base portion 134 by casting or by drilling a blank for the base portion. The mounting portion 138 has an opening 142 capable of receiving a fastener, i.e., screw, bolt or the like, to secure the grabfoot-shape to the railway car. The ring 140 in the base portion 134 has a single pin hole 132 having a size and angle that permits alignment with any of the holes 101 in the rod member 104, as is best illustrates by FIG. 10. The ring pin holes 132 extends at least from the front outer surface of the ring 140 to the front inner surface. In addition, the ring pin hole may continue through the rear inner surface of the ring 140 and extend a distance toward and even through the rear outer surface.

The handhold-shape and grabfoot-shape are fastened together by the use of a steel expansion pin 150 placed through both the pin hole 132 in the base portion ring of the grabfoot-shape as well as through one of the pin holes 101 in the rod member 104. The pin 150 may be inserted by striking the pin with a hammer, the force of which compresses the pin and drives it into the aligned holes. The pin is sized to lie flush with the outer surface of the ring, once it has been inserted. Also, once in place, the natural spring loading feature of the pin will maintain the pin securely in the hole. The pin hole 132 is also formed at the same angle $\alpha$ and lies in the common plane defined by the series of holes in the rod member 104, to allow alignment for the steel expansion pin to fit in both pin hole 132 and the appropriate pin hole 101 in the rod member 104. The holes may be formed in a variety of ways known in the art; however, drilling is preferred since it minimizes stress on the rod member and base portion materials. In a preferred embodiment, the angle $\alpha$ is approximately 30 degrees for convenience of inserting the pin. However, $\alpha$ may range from 20° to 60° in order to produce an effective downward gravitational force vector, allowing for a more secure fastening between the handhold-shape and the grabfoot-shape with the mounting pin. In addition, such a construction prevents the pin from falling out. Clearly, the angle $\alpha$ is not limited to this range in obtaining the benefits of the present invention.

The force of the pin may be enhanced by glue, weld, or other securing techniques. Moreover, instead of using a steel expansion pin 150, a screw may be used to secure the grabfoot-shape 130 to the handhold-shape 102. However, the rod member pin holes 101 and the base pin hole 132 must be drilled to include threads for proper securing. Alternatively, a bolt may be used. Glue or welding may also be used in combination with such techniques to further secure the pieces together.

Figure 4:
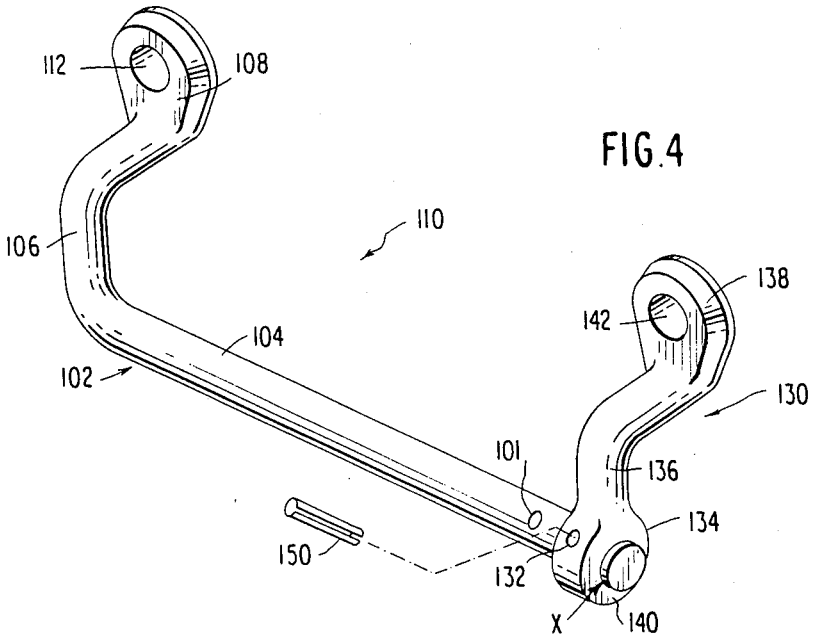
FIG. 4 is a perspective view of a combined double-offset handhold-shape and double-offset grabfoot-shape of the present invention, with the rod member cut to the appropriate length.
Figure 5:
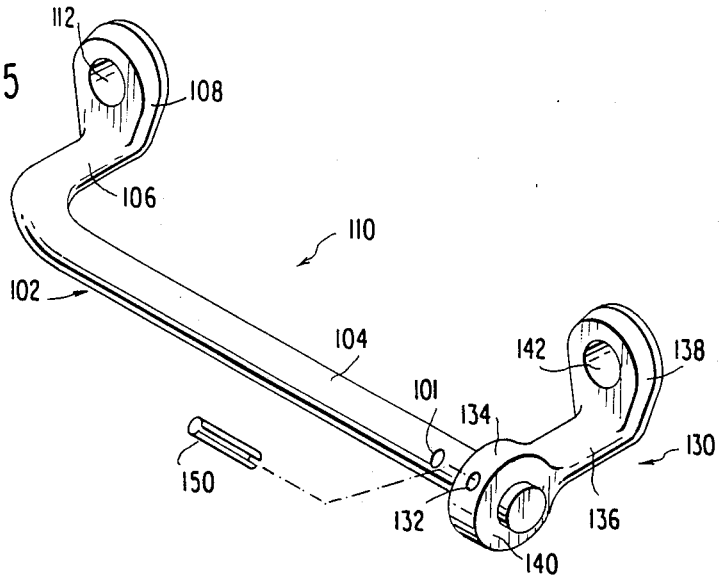
FIG. 5 is a perspective view of a combined single-offset handhold-shape and single-offset grabfoot-shape of the present invention, with the rod member cut to the appropriate length.
Figure 6:
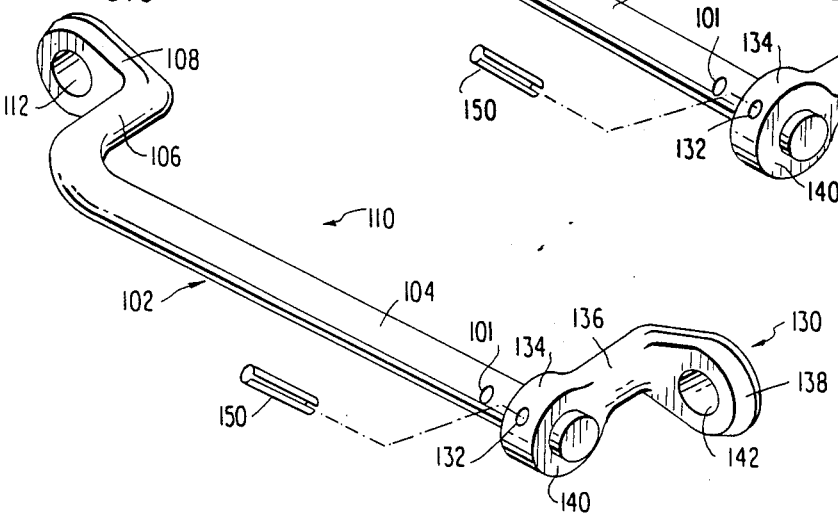
FIG. 6 is a perspective view of a combined straight-offset handhold-shape and straight-offset grabfootshape of the present invention, with the rod member cut to the appropriate length.
Figure 7:
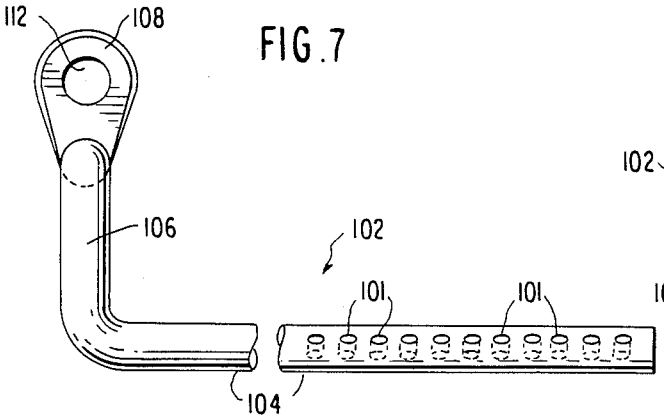
FIG. 7 is a front elevation view of a double-offset handhold-shape of the present invention, employed in FIG. 4.
Figure 11:
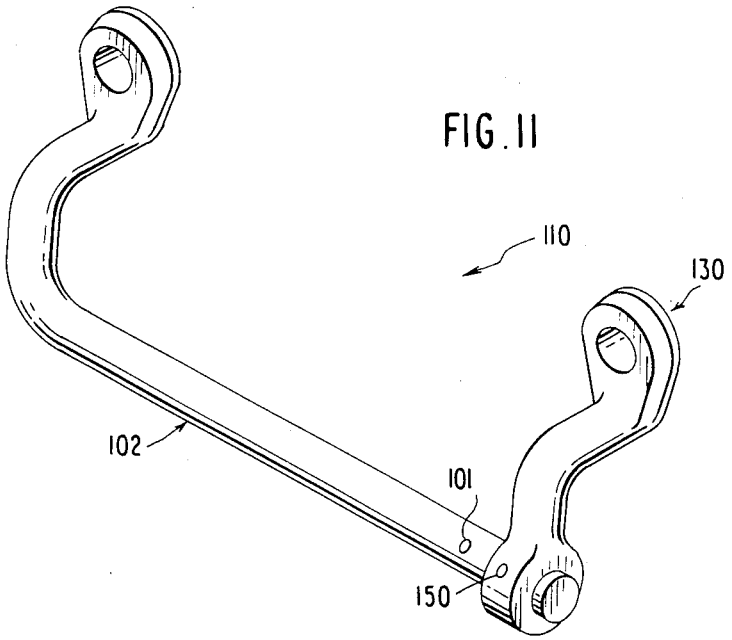
FIG. 11 is a perspective view of the present invention with the rod member cut to the appropriate length and both pieces secured by the steel expansion pin.

FIGS. 4–6 and 11 illustrate the present invention with the rod member 104 cut to the appropriate length at X. FIG. 4 illustrates a combined double-offset handhold-shape 102 and double-offset grabfoot-shape 130. FIG. 5 illustrates an alternative embodiment where a single-offset handhold-shape 102 is combined with a single-offset grabfoot-shape 130. FIG. 6 illustrates a straight-offset handhold-shape 102 and straight-offset grabfoot-shape 130. In FIG. 11, both pieces are shown secured by the use of the steel expansion pin 150 inserted in aligned holes 132 and 101. It should be noted that the use of an integral ring in the base portion assures that the pin holes in the rod and the pin holes in the base will be aligned. Unlike the incomplete torus ring in the prior art, deformation and, thus, misalignment of the pin holes is minimized.

The invention may be applied to provide a safer and more efficient method of securing two-piece grab irons not only on railway cars, but also on other transportation vehicles. In addition, the invention may be used to form climbing steps on such items as oil tanks and water towers.

The invention has been described in detail, but it will be understood that variations and modifications can be effected within the spirit and scope of the invention.

What is claimed is:

1. An adjustable grab iron configuration for rolling stock, comprising:

a first member having a mounting flange portion and a rod member, said rod member having a series of rod member pin holes that are spaced along at least a portion of said rod member, said rod member pin holes being formed at a common angle;

a second member having a mounting flange portion, and a base portion, said base portion having a ring portion having a hole sized to receive said rod member and a pin hole being formed at said common angle, thereby permitting alignment with any of said rod member pin holes.

2. The adjustable grab iron configuration for rolling stock of claim 1 further comprising:

securing means for insertion into one of said rod member pin holes and said base pin hole when said holes are aligned.

3. The adjustable grab iron configuration for rolling stock of claim 1 wherein said first and second members are secured together by the use of a metal fastener placed through the base pin hole and the appropriate rod member pin hole, and where said rod member is sized not to substantially extend beyond said second member.

4. The adjustable grab iron for rolling stock of claim 1, wherein said ring portion has a front outer surface and a front inner surface and said base pin hole extends from said front outer surface to said front inner surface of said ring portion.

5. The adjustable grab iron for rolling stock of claim 4, wherein said ring portion has a rear inner surface and a rear outer surface and said base pin hole further extends into said rear inner surface toward said rear outer surface of said ring portion.

6. The adjustable grab iron for rolling stock of claim 1, wherein said rod member has a front top surface and a rear bottom surface and said rod member pin hole extends from said front top surface to said rear bottom surface of said rod member.

7. The adjustable grab iron for rolling stock of claim 1, wherein said rod member pin holes are regularly spaced along at least a portion of said rod member.

8. The adjustable grab iron for rolling stock of claim 1, wherein said pin holes are drilled at an angle that produces a downward gravitational force vector allowing for a more secure fastening between said first member and said second member.

9. The adjustable grab iron for rolling stock of claim 2, wherein said securing means comprises a steel expansion pin, having a natural spring loading.

10. The adjustable grab iron for rolling stock of claim 9, wherein said pin is further secured by at least one of glue and welds.

11. The adjustable grab iron for rolling stock of claim 1, wherein said ring portion comprises one of drilled second member and a cast second member second member.

12. The adjustable grab iron for rolling stock of claim 2, wherein said securing means comprise a screw, at least one of said rod member pin holes and said base pin hole being threaded to receive said screw.

* * * * *